United States Patent [19]

Schaal et al.

[11] Patent Number: 4,509,731

[45] Date of Patent: Apr. 9, 1985

[54] WORKBENCH WITH REMOVABLE VISE

[75] Inventors: Günter Schaal; Heribert Schramm, both of Stuttgart, Fed. Rep. of Germany

[73] Assignee: Robert Bosch GmbH, Stuttgart, Fed. Rep. of Germany

[21] Appl. No.: 504,473

[22] Filed: Jun. 15, 1983

[30] Foreign Application Priority Data

Jun. 18, 1982 [DE] Fed. Rep. of Germany ..... 3222750

[51] Int. Cl.[3] ..... B25B 1/10

[52] U.S. Cl. ..... 269/78; 269/88; 269/100; 269/283; 269/261; 269/900; 269/901

[58] Field of Search ..... 144/286 R, 286 A, 287; 269/900, 99, 100, 901, 88, 77–78, 283, 261

[56] References Cited

U.S. PATENT DOCUMENTS

| | | | |
|---|---|---|---|
| 623,175 | 4/1899 | Palmer | 269/99 |
| 1,205,884 | 11/1916 | Gorlitz | 144/286 R |
| 1,515,915 | 11/1924 | Valenta | 269/100 |
| 1,954,708 | 4/1934 | Mass | 269/900 |
| 4,157,819 | 6/1979 | Meyer | 269/900 |
| 4,181,296 | 1/1980 | Bassett | 269/88 |
| 4,199,135 | 4/1980 | Wohrle et al. | 269/901 |
| 4,330,113 | 5/1982 | Ferdinand et al. | 269/88 |
| 4,415,149 | 11/1983 | Rees | 269/88 |

FOREIGN PATENT DOCUMENTS

| | | | |
|---|---|---|---|
| 58799 | 4/1913 | Fed. Rep. of Germany | 144/286 R |

*Primary Examiner*—Robert C. Watson

*Attorney, Agent, or Firm*—Frishauf, Holtz, Goodman & Woodward

[57] ABSTRACT

A workbench (1) has a removable vise (3) and a workplate (5) separate from the vise and provided with apertures (6) for clamping elements. A jaw assembly (15) having a fixed vise jaw (16) and likewise a jaw assembly (17) equipped with an adjustable jaw (18) can be screwed onto a vise base (14) so as to resist all twisting forces. The screw fastenings (28 to 30) are such that they can also serve to attach the jaw assemblies to the workplate (5), using the apertures (6) in the latter for that purpose. The vise as a whole can be mounted in a rotary seat (2) where its mandrel (13) can be clamped at different levels and rotary positions, with the further possibility of having the rotary position fixed in the lowest position of the vise in a manner suitable for maintaining parallelism with another rotary vise similarly mounted (not shown in figure).

9 Claims, 4 Drawing Figures

WORKBENCH WITH REMOVABLE VISE

This invention concerns a workbench having a removable vise and having a workplate separate from the vise which has apertures for clamping or stop elements.

A known workbench of that general type is shown in German Pat. No. 929 321. The demountable vise there shown, however, is usable exclusively with the specially prepared workplate of a workbench. The clamp element of the vise cannot be inserted or used in another way.

Another known workbench of the same general type provides for the seating of at least one vise where it is separated from the workplate. The vice can be removed from that seat as an entire unit for clamping in the manner of a box clamp.

In both of the previously known constructions above mentioned the scope of application of the vise is limited.

SUMMARY OF THE INVENTION

It is an object of the invention to provide a workbench with one or more removable vises of a kind that lends itself to a variety of uses both on and off the workbench.

Briefly, the removable vise comprises a vise base, a jaw assembly for a fixed jaw and a jaw assembly for an adjustable jaw and means for attaching the jaw assemblies to the vise base by the use of apertures in the vise base that are of the same dimensions as the apertures in the workplate. Thus the jaw assemblies can similarly be fastened to the workplate as an alternative to being mounted on the vise base, the latter being preferably provided with a rotary mount at a portion of the workbench separated from the workplate. The fastening means are preferably clamp screws passing through cylindrical apertures in the vise base or in the workplate.

The workbench of the invention has the advantage that the clamping elements of the removable vise can be used both, with the vise base, as a bench vise and also, without the base, for clamping work pieces of larger size on the workplate of the bench.

The use of clamping screws with hand knobs for clamping the jaw assemblies into place has the special advantage of facilitating quick conversion or replacement of the jaw assemblies and their fixation in any particular rotary position by hand without the use of tools.

BRIEF DESCRIPTION OF THE DRAWINGS

The invention is further described by way of illustrative example with reference to the annexed drawings, in which.

DESCRIPTION OF THE PREFERRED EMBODIMENT

Figure 1:
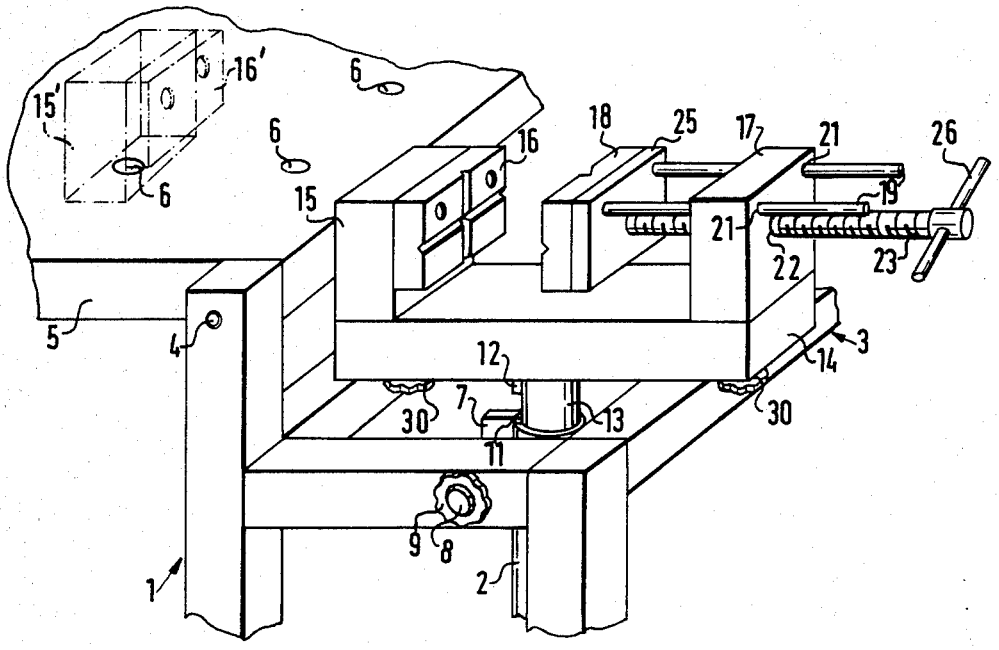
FIG. 1 is a partial perspective view of a workbench according to the invention showing, completely, one removable vise.
Figure 2:
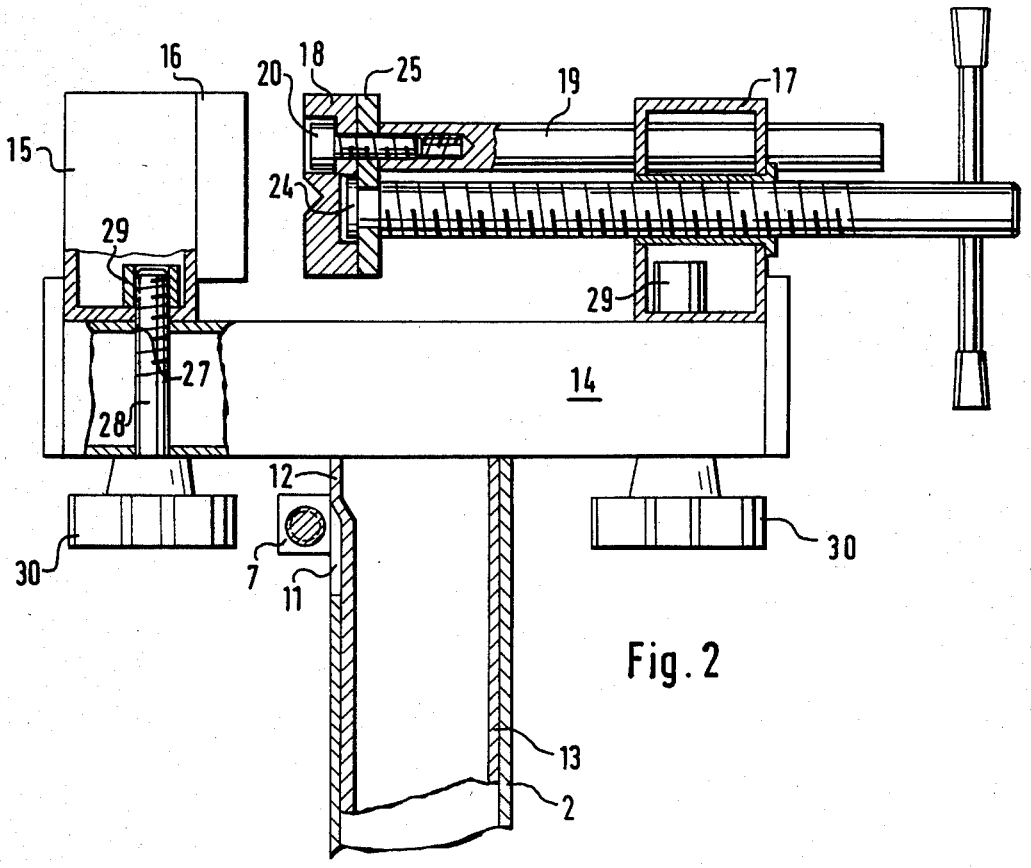
FIG. 2 is a view in section of the removable vise of FIG. 1.

As shown in FIG. 1 a workbench 1 has a tubular seat 2 (more particularly visible in the other figures) for the stem or mandrel 13 of a vise 3. The workbench has a pivoted workplate 5 pivoting on pins 4 which is supported in the position shown in FIG. 1 by an extension arm, not shown in the drawing, of the workbench 1. The workplate 5 has apertures 6 for clamping elements of various kinds.

Figure 4:
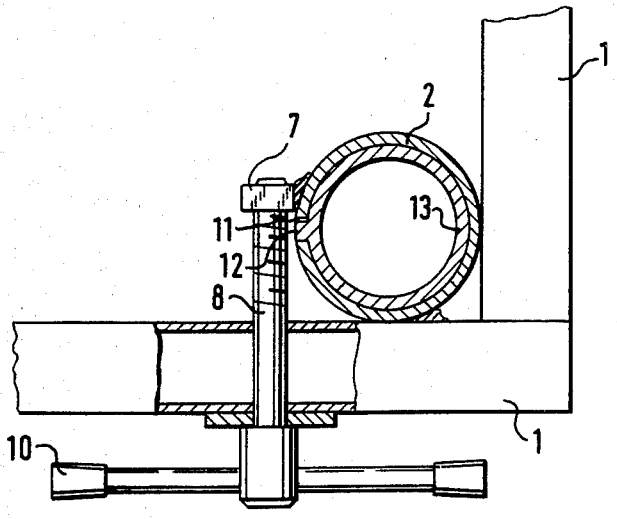
FIG. 4 is a plan view of a section of FIG. 2 in a plane underneath the vise base.
Figure 3:
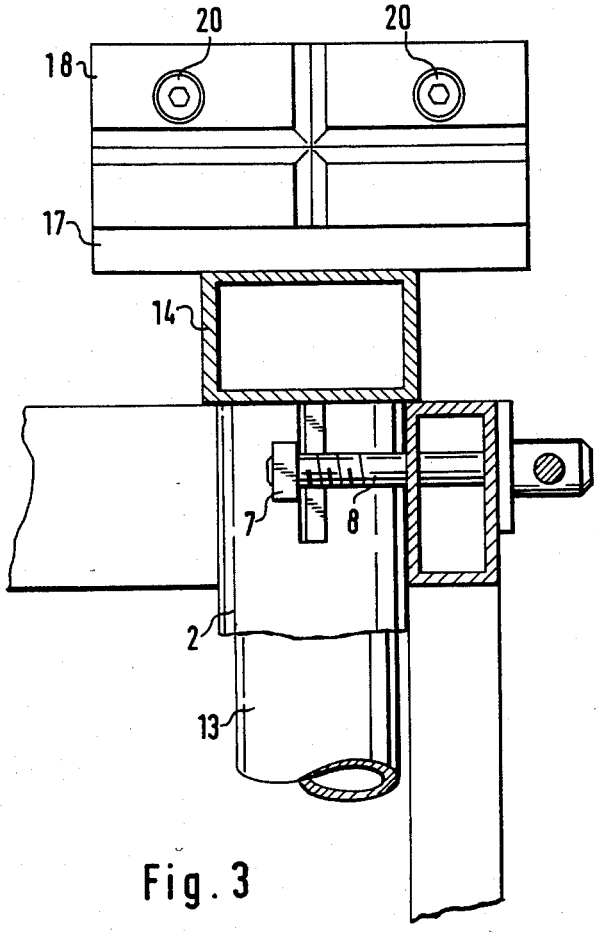
FIG. 3 is a side elevation, partly in section, of a portion of the vise of FIG. 2 with the jaw assembly carrying the fixed jaw removed.

The seating or mounting tube 2 is slotted and has a threaded bracket 7 connected to a clamp screw 8 passing through the frame of the workbench 1. The clamp screw 8 can be rotated by a hand grip knob 9 or by a crossbar 10 (FIG. 4). A notch 11 in the tubular mounting element 2 is provided for the seating of a radial projection 12 affixed on the mandrel 13 extending from the bottom of the vise base 14. The vise base 14 carries a jaw assembly 15 equipped with a fixed jaw 16 and also a jaw assembly 17 equipped with an adjustable jaw 18. Guide rods 19 are affixed to the adjustable jaw 18 by means of screws 20. These rods 19 are guided in bores 21 in the jaw assembly 17. A clamping spindle 23 is screwed into a spindle bore 22 of the jaw assembly 17. The end of the spindle 23 directed towards the adjustable jaw 18 is connected to the latter by a cap plate or flange 24 and a holding plate 25. The end of the spindle projecting to the exterior is equipped in a known way with a crossbar 26.

The vise base 14 has bores 27 through which clamping screws 28 pass to engage in threaded bores 29 in the jaw assemblies 15 and 17. The bores 27 correspond to the apertures 6 in the workplate 5 in diameter and length. The clamp screws are provided with hand grip knobs 30 at their heads.

In the construction of the workbench shown in FIG. 1 one of two vises 3 is shown set into a tubular seat 2. In the illustrated insertion position of the mandrel 13 in the seat 2, the vise 3 can be rotated into any desired position—fully 360°—and can be clamped in any such position by the clamp screw 8. If the mandrel 13 is fully inserted in the tubular seat 2, so that the projection 12 engages in the notch 11, the rotary position of the vise 3 is fixed. If two vises 3 are mounted on the workbench 3 in this manner, they are oriented parallel to each other.

By loosening the clamp screws 28 the jaw assemblies 15 and 17 can be released from the vise base 14 and can then be fastened onto the workplace 5. The jaw assembly 15' with the fixed jaw 16', drawn in dot-dash lines in FIG. 1, illustrates this possibility.

When the jaw assemblies 15 and 17 are used in connection the vise base 14 their position can be supplementarily secured at right angles to the vise base 14 in a known way, for example by means of an index pin (not shown).

The workbench and its removable vises as above described have a versatility of use extending beyond what has heretofore been known.

Although the invention has been described with reference to a particular illustrative example, modifications and variations are possible within the inventive concept. For example, other known kinds of clamp pins can be set into certain of the spertures 6 and used together with the jaw assembly 17 and its adjustable jaw 18, mounted on the workplate 5, for securing on the workplate a workpiece of irregular configuration.

We claim:

1. Workbench having a removable vise (3), a seat cavity for rotary mounting of said vise, and a workplate (5) separate from said vise provided with apertures for seating clamp elements, said workbench comprising the improvements wherein:

said removable vise (3) comprises a vise base (14) having apertures (27) corresponding in their dimensions to said apertures (6) of said workplate (5) and a downwardly extending mandrel (13) for rotary mounting of said removable vise, a first jaw assembly (15,16) with a fixed jaw (16), a second jaw assembly (17,18) with an adjustable jaw (18) and means (28-30) for fastening said jaw assemblies selectively either to said vise base (14) or to said workplate (15) and for detaching said jaw assemblies therefrom, said fastening and detaching means including elements of elongated configuration suitable for passing respectively through said apertures of said vise base or of said work plate, for grasping said jaw assemblies at one end of said elongated configuration and for manual fastening or detaching actuation at the other end of said configuration.

2. Workbench according to claim 1, in which said fastening and detaching means include threaded bores (29) in said jaw assemblies (15,17) and clamp screws (28), said clamp screws constituting said elongated elements of said fastening means and being of a length suitable for clamping said jaw assemblies either to said vise base (14) or to said workplate (5).

3. Workbench according to claim 1, in which said aperture (6) in said work plate and said apertures (27) in said vise base (14) are cylindrical passages.

4. Workbench according to claim 2, in which said aperture (6) in said work plate and said apertures (27) in said vise base (14) are cylindrical passages.

5. Workbench according to claim 1, in which said seat cavity for rotary mounting of said removable vise is provided by a socket mount on the workbench in the form of an outwardly open slotted tube (2) affixed in the workbench and equipped with means, including a clamp screw (8), for adjusting its inner diameter, as well as having a notch (11), said vise base (14) mandrel (13) extending from its under side being of a dimension for fitting in said tube and having a radial projection (12) for fitting in said notch (11) for holding said vise base in a predetermined orientation.

6. Workbench according to claim 5, in which said workbench is equipped for rotary mounting of a second removable vise (3) identical with said previously mentioned removable vise (3) and for readily setting both removable vises in parallelism, both a first and a second said tubes (2) being affixed in said workbench (1) for mounting said respective portable vises in parallelism with each other, each said tube (22) having its said notch (11) aligned for indexing said portable vises parallel to each other.

7. Workbench according to claim 2, in which said clamp screws (28) are equipped with knobs (30) for manual tightening and loosening thereof.

8. Workbench according to claim 5, in which said notch (11) of said tube (2) and said radial projection (12) of said mandrel are of such respective configuration that they are capable of mutual engagement only over a portion of the clamping length of said mandrel (13).

9. Workbench according to claim 1, in which said jaw assemblies (15,17) and said vise base (14) are capable of attachment in a manner secure against twisting forces.

* * * * *